US005816264A

United States Patent [19]

Sebastiani

[11] Patent Number: 5,816,264

[45] Date of Patent: Oct. 6, 1998

[54] BIO-HUMIDOR

[75] Inventor: Sam J. Sebastiani, Sonoma, Calif.

[73] Assignee: Viansa Winery & Italian Marketplace, Sonoma, Calif.

[21] Appl. No.: 922,216

[22] Filed: Sep. 2, 1997

[51] Int. Cl.[6] ..... A24F 13/00

[52] U.S. Cl. ..... 131/329; 131/328; 131/290; 131/291

[58] Field of Search ..... 131/329, 328, 131/290, 291; 312/31

[56] References Cited

U.S. PATENT DOCUMENTS

| | | | |
|---|---|---|---|
| 1,938,384 | 7/1933 | Hauch | 312/31 |
| 1,983,691 | 4/1934 | Bonardi | 312/31 |
| 2,740,683 | 4/1956 | June | 312/31 |
| 4,008,930 | 2/1977 | Swainson | 312/31.1 |
| 5,011,009 | 4/1991 | Scheurer | 206/270 |
| 5,607,051 | 3/1997 | Espinosa | 206/213.1 |

OTHER PUBLICATIONS

Bati, Anwer & Chase, Simon, "The Cigar Companion—A connoisseur's Guide," 2nd Edition, Running Press, p.40, 1995.

Associated Press, "A Bourbon and Cigar Rolled Into One," Nov. 1, 1997.

Gardner, Jim, "Gardner's Collectibles" Website, Nov. 11, 1997.

Advertisement, Maker's Mark Bourbon Seasoned Cigars, Cigar Aficionado, p. 534, Dec. 1997.

*Primary Examiner*—John G. Weiss
*Assistant Examiner*—Charles W. Anderson
*Attorney, Agent, or Firm*—Haverstock & Owens LLP

[57] ABSTRACT

An apparatus for and method of imparting moisture to a cigar or tobacco product is a bio-humidor. The bio-humidor includes a moisture impervious housing configured to hold the cigar, a moisture impervious lid, and a moisture imparting element configured for storage in the housing with the cigar. In use, the cigar is placed inside the moisture impervious housing along with the moisture imparting element. The housing is then closed and sealed, such as by joining a zip-lock, closing a lid, threading a top, or inserting a stopper, such as a cork, into an opening. Moisture from the moisture imparting element will then pass to the cigar within the closed environment of the sealed housing and thereby maintain a fresh, moist cigar.

18 Claims, 1 Drawing Sheet

BIO-HUMIDOR

FIELD OF THE INVENTION

The present invention relates to the field of tobacco and tobacco product storage. More particularly, the present invention relates to a method of and an apparatus for long-term storage of cigars so as to preserve them in a condition of freshness.

BACKGROUND OF THE INVENTION

Cigar smoking has undergone a renaissance in the 1990's with women as well as men enjoying the pleasures and social benefits of cigar smoking. The focus of this renewed popularity has been fine handmade cigars made from carefully selected tobaccos grown throughout the world. Tobacco plants grown in the regions of The Dominican Republic, Honduras, Nicaragua, and Cuba are thought to yield the finest tobacco product. Manufacturers utilize different tobacco plant varietals to construct the components of the cigar, which comprise the filler, binder, and wrapper. Cigar connoisseurs profess an ability to detect subtle differences between the plant varietals used in cigar manufacture, and can distinguish cigars made from different regions and producers. The 1990's have also brought publication of books and magazines which evaluate and grade various brands of cigars in much the same manner as is done with vintage wines.

In much the same way that temperature influences the ability of wine to fully open up and express its flavor, the moisture content of a cigar is active in determining how well the cigar will smoke and realize its potential. It is well known that cigars stored in an arid environment become dry and hard and are undesirable to smoke. Dry cigars burn too rapidly and taste hot and unpleasant, often described as dusty and acrid. Once dry, a cigar looses most of its bouquet and cannot compare to a well-kept cigar. Conversely, a cigar smoked when too wet will not burn well and will require frequent relighting. Also, overly moist cigars taste sharp and aggressive. Therefore, for the optimum smoking experience, cigars should be kept at some intermediate ideal condition. The ideal conditions in which to keep cigars are 65 to 70 percent relative humidity and 61 to 64 degrees fahrenheit, the most important being the relative humidity. However, if the temperature is allowed to vary, the air will expand and contract and correspondingly impact the relative humidity. Fine cigars are made of delicate high quality natural leaf tobacco possessing a smooth and rich flavor and must be consumed within these ideal conditions to realize the fullest enjoyment.

Cigar humidors are well known in the prior art and most cigar smokers own a tabletop model. The typical prior art humidor is a wooden box with a hinged top containing a source of moisture which is allowed to evaporate. The evaporating moisture is absorbed by the air within the humidor which in turn is absorbed by the dry cigars contained therein. The moisture source within these types of humidors can be water-absorbent stones, sponges, or plastic storage vessels. This technique of humidification is adequate for bulk cigars placed within the humidor, but is problematic for cigars sold individually within prepackaged tubes or containers because the moisture will be unable to penetrate the prepackaged container seal.

For cigars sold individually within prepackaged tubes or containers, it is well known in the prior art to insert a cedar wrap around the cigar prior to insertion into the container. Cedar has the characteristic of helping the cigar maintain its moisture as well as furthering the cigar's maturation process. World supply of cedar, however, is diminishing and an alternative with similar or superior moisture imparting properties is needed. Further, considerable handling is necessary to prepare the cedar. The tree must be cut down, transported, and then sliced into thin sheets which are sufficiently thin to wrap around a cigar but sufficiently thick to avoid breaking.

SUMMARY OF THE INVENTION

The invention is a bio-humidor for a cigar, or other tobacco product. The invention comprises a moisture impervious housing configured to hold the cigar; a moisture impervious lid; and a moisture imparting element configured for storage in the housing with the cigar. Any moisture impervious, sealable, housing that can hold both the cigar and the moisture imparting element is suitable for this invention. In use, the cigar is placed inside the moisture impervious housing along with the moisture imparting element. The housing is then closed and sealed, such as by joining a zip-lock, closing a lid, threading a top, or inserting a stopper, such as a cork, into an opening. It is helpful to affix an adhesive backed label to the lid and housing to hold the lid in place. Moisture from the moisture imparting element will then pass to the air and from the air to the cigar within the closed environment of the sealed housing and thereby maintain a fresh, properly moist cigar. In addition to moisture, the moisture imparting element can also infuse flavorizing and aromatic essence into the cigar and thereby further enrich the enjoyment of the smoking experience.

Although the primary objective of the invention is to moisten a cigar under storage, care must be taken in the selection of the moisture imparting element to properly control the amount of moisture released. A moisture imparting element that releases too little moisture will not adequately moisten the cigar. Conversely, a moisture imparting element which releases excessive moisture will dampen the cigar and can cause mold.

Another objective of the invention is to provide cigar storage devices with a moisture imparting element that is natural and readily available as well as possessing the moisture imparting, flavorizing, and aromatic properties outlined above. Experiment has determined that herbs are perfectly suited for this task. Furthermore, within the category of herbs, experiment has determined that the herb rosemary is an ideal choice for this invention. Rosemary is inexpensive, readily grown, and has the desired moisture imparting ability required for this invention. Parsley and basil were also utilized under experiment but found to release excessive moisture and caused the cigar to mold.

It will be apparent to anyone skilled in the art that use of this invention need not be limited to cigar products alone, as any tobacco product would realize the benefits of this application.

DETAILED DESCRIPTION OF A PREFERRED EMBODIMENT

Figure 1:
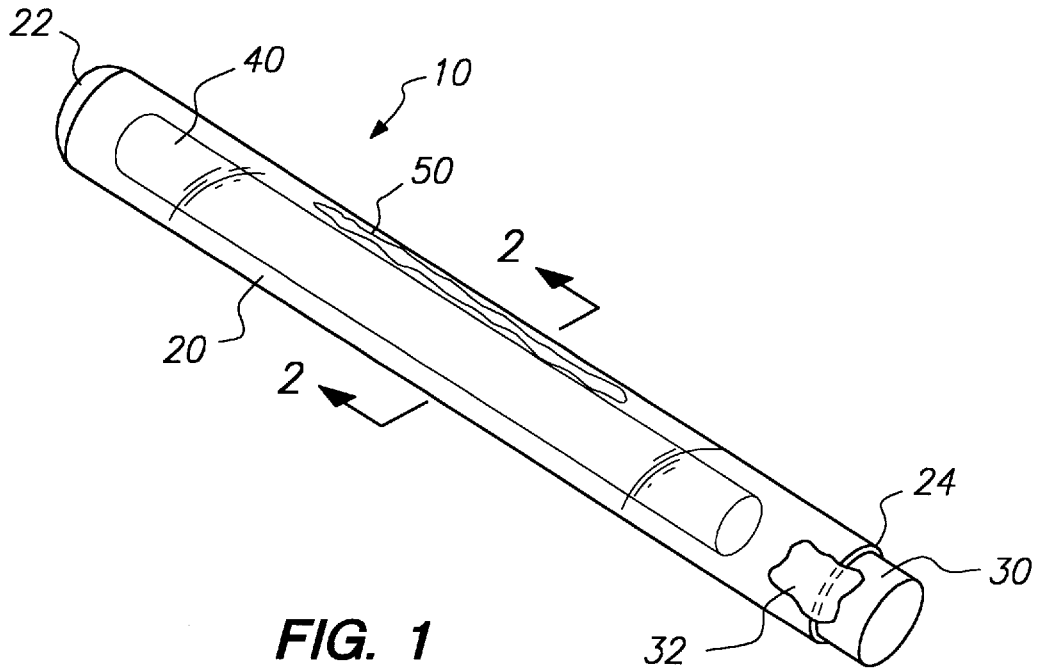
FIG. 1 is a perspective view of a humidor in accordance with the subject invention.
Figure 2:
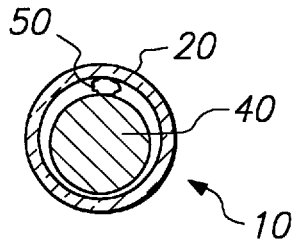
FIG. 2 is cross-sectional view taken along line 2—2 in FIG. 1 and looking in the direction of the arrows.

A cigar bio-humidor in accordance with the subject invention is identified by numeral 10 in FIGS. 1 and 2. The bio-humidor 10 comprises a moisture impervious housing configured to hold the tobacco product; a moisture impervious lid wherein the lid is configured for coupling to the housing and forming a moisture impervious seal thereby; and a moisture imparting element configured for storage in the housing with the tobacco product such that when the lid is sealed to the housing, moisture from the moisture imparting element can pass from the moisture imparting element to the tobacco product via the internal air of the sealed housing. The present embodiment of the bio-humidor 10 comprises a tubular member 20, a lid 30, and the herb rosemary as the moisture imparting element 50, all of which satisfy the criteria identified above for the respective components.

The tubular member 20 is preferably constructed of glass, as shown, but can also be made of thin gauge sheet metal or plastic, and has the property of being closed at one end 22 and open at the other 24. It will be readily apparent to anyone skilled in the art that materials other than those named can be utilized in the construction of the tubular member 20. Also, use of transparent material in the construction of the tubular member 20 is especially advantageous since the aesthetic appeal of the cigar contained therein will be immediately apparent.

The open end 24 of the tubular member 20 can be closed by coupling the lid 30 to the tubular member 20 and forming a moisture impervious seal thereby. The lid 30 can be constructed of cork, plastic, rubber, or thin gauge sheet metal and can be applied by insertion into, or threaded upon or in, the tubular member 20. It will be readily apparent to anyone skilled in the art that materials other than those named can be utilized in the construction of the lid 30. The lid 30 enjoys the additional feature of having the capacity to be removed and then reapplied for as many times as the user desires. However, for initial storage, an adhesive backed label 32 is preferably affixed to the lid and housing to hold the lid in place.

In use, the cigar 40 is inserted into the opening of the tubular member 20 along with the moisture imparting element 50. Once inside the tubular member 20, the cigar 40 and moisture imparting element 50 can be sealed therein by coupling the lid 30 to the tubular member 20. Moisture from the moisture imparting element 50 will then pass to the air and from the air to the cigar 40 within the closed environment of the sealed tubular member 20 and thereby maintain a fresh, properly moist cigar. In addition to moisture, the moisture imparting element 50 will also infuse flavorizing and aromatic essence into the cigar 40 and thereby further enrich the enjoyment of the smoking experience.

It is an objective of the invention that in addition to possesing the moisture imparting, flavorizing, and aromatic properties outlined above, the moisture imparting element 50 be composed of organic matter readily found in nature. Experiment has shown that herbs are well suited for this task because they possess the desired moisture imparting, flavorizing, and aromatic properties, and also are inexpensive and readily grown. In particular, experiment has shown rosemary to be an ideal choice. An attempt was made at using parsely and basil but met with negative results due to the excessive moisture content of the herbs. However, parsely and basil, as well as other inherently moist herbs, could be used if they were subjected to an initial dehydration step prior to insertion into the sealed tubular member 20.

It will be apparent to anyone skilled in the art that use of this invention need not be limited to cigar products alone, as any tobacco product would realize the benefits of this application. Additionally, while this invention has been described with respect to a certain preferred embodiment, it is apparent that various changes can be made without departing from the scope of invention as herein defined by the appended claims.

What is claimed is:

1. A moisture imparting storage device including a tobacco product, comprising:

(a) a moisture impervious housing configured to hold the tobacco product;

(b) a moisture impervious lid wherein the lid is configured for coupling to the housing and forming a moisture impervious seal; and (c) a portion of a naturally moist organic plant stored in the housing for use with the tobacco product such that when the lid is sealed to the housing, moisture from the portion of the naturally moist organic plant can pass from the moisture imparting element to the tobacco product.

2. The moisture imparting storage device of claim 1 wherein the moisture impervious housing is a tubular member closed at one end.

3. The moisture imparting storage device of claim 2 wherein the tubular member is constructed of glass.

4. The moisture imparting storage device of claim 2 wherein the tubular member is constructed of thin gauge sheet metal.

5. The moisture imparting storage device of claim 2 wherein the tubular member is constructed of plastic.

6. The moisture imparting storage device of claim 2 wherein the lid is constructed of cork.

7. The moisture imparting storage device of claim 2 wherein the lid is constructed of rubber.

8. The moisture imparting storage device of claim 1 wherein the portion of the naturally moist organic plant infuses flavorizing and aromatic essence into the tobacco product.

9. The moisture imparting storage device of claim 1 wherein the portion of the naturally moist organic plant is a herb.

10. The moisture imparting storage device of claim 9 wherein the herb is rosemary.

11. A method of imparting moisture to a tobacco product, which comprises:

(a) providing a moisture impervious housing configured to hold the tobacco product;

(b) inserting a portion of a naturally moist organic plant as a moisture imparting element configured for storage in the housing with the tobacco product such that moisture from the moisture imparting element can pass from the moisture imparting element to the tobacco product; and (c) sealing the housing, with the tobacco product and moisture imparting element therein, with a moisture impervious lid wherein the lid is configured for coupling to the housing and forming a moisture impervious seal.

12. A method of inserting a moisture imparting element as recited in claim 11, wherein the moisture imparting element comprises a natural and organic material.

13. A method of inserting the natural and organic material as recited in claim 12, wherein the natural and organic material is a herb.

14. A method of inserting herbs as recited in claim 13, wherein the herb is rosemary.

15. A method of infusing flavor and aromatic essence into a tobacco product, which comprises:

(a) inserting the tobacco product into an essence impervious housing configured to hold said tobacco product;

(b) inserting into the housing a portion of a naturally moist organic plant as a flavorizing and aromatic essence imparting element configured for storage with the tobacco product in the housing wherein flavor and aroma from the element passes from the element to the tobacco product; and sealing the housing, with the tobacco product and essence imparting element therein, with an essence impervious lid wherein the lid is configured for coupling to the housing and forming an essence impervious seal.

16. A method of inserting a flavorizing and aromatic essence imparting element as recited in claim 15, wherein the flavorizing and aromatic essence imparting element comprises an organic material.

17. A method of inserting natural and organic material as recited in claim 16, wherein the natural and organic material is a herb.

18. A method of inserting herbs as recited in claim 17, wherein the herb is rosemary.

* * * * *

UNITED STATES PATENT AND TRADEMARK OFFICE

CERTIFICATE OF CORRECTION

PATENT NO. : 5,816,264

DATED : October 6, 1998

INVENTOR(S) : Sam J. Sebastiani

It is certified that an error appears in the above-identified patent and that said Letters Patent is hereby corrected as shown below:

TITLE PAGE:
In the References cited:

Before "Hauch" and after "1,938,384" replace "7/1933" with --12/1933--.

Before "Bonardi" and after "1,983,691" replace "4/1934" with --12/1934--.

Signed and Sealed this

Sixteenth Day of March, 1999

*Attest:*

Q. TODD DICKINSON

*Attesting Officer*

*Acting Commissioner of Patents and Trademarks*